US007004085B2

(12) United States Patent
Platvoet et al.

(10) Patent No.: US 7,004,085 B2
(45) Date of Patent: Feb. 28, 2006

(54) CRACKING FURNACE WITH MORE UNIFORM HEATING

(75) Inventors: Erwin M. J. Platvoet, Jersey City, NJ (US); John V. Albano, Oradell, NJ (US); Frank D. McCarthy, Wayne, NJ (US); J. Paul Fell, Wall Township, NJ (US)

(73) Assignee: ABB Lummus Global Inc., Bloomfield, NJ (US)

( * ) Notice: Subject to any disclaimer, the term of this patent is extended or adjusted under 35 U.S.C. 154(b) by 538 days.

(21) Appl. No.: 10/120,072

(22) Filed: Apr. 10, 2002

(65) Prior Publication Data

US 2003/0213687 A1 Nov. 20, 2003

(51) Int. Cl.
*F23J 15/00* (2006.01)

(52) U.S. Cl. ..... 110/203; 110/317; 110/319; 204/193; 431/326; 431/328; 422/197; 422/198

(58) Field of Classification Search ..... 431/326, 431/328; 204/193; 110/317, 319, 203; 422/197, 422/198

See application file for complete search history.

(56) References Cited

U.S. PATENT DOCUMENTS

| | | | |
|---|---|---|---|
| 3,267,910 | A | 8/1966 | Guerrieri |
| 3,274,978 | A | 9/1966 | Palchik et al. |
| 3,947,326 | A | 3/1976 | Nakase et al. |
| 3,972,682 | A | 8/1976 | Stephens et al. |
| 4,008,128 | A | 2/1977 | Dorner |
| 4,014,749 | A | 3/1977 | Dorner et al. |
| 4,101,376 | A | 7/1978 | Cornelius et al. |
| 4,160,701 | A | 7/1979 | Dorner et al. |
| 4,762,958 | A | 8/1988 | Martens et al. |
| 4,777,318 | A | 10/1988 | Martens et al. |
| 4,819,586 | A | 4/1989 | Kreuter |
| 4,999,089 | A | 3/1991 | Nakase et al. |
| 5,151,158 | A | 9/1992 | Bowen et al. |
| 5,181,990 | A | 1/1993 | Arisaki et al. |
| 5,206,880 | A | 4/1993 | Olsson |
| 5,271,809 | A | 12/1993 | Holzhausen |
| 5,799,623 | A | 9/1998 | Born et al. |
| 6,210,747 | B1 | 4/2001 | Trotter, Jr. |

FOREIGN PATENT DOCUMENTS

| | | |
|---|---|---|
| EP | 0305799 | 3/1989 |
| EP | 0 519 230 A1 | 12/1992 |
| EP | 0519230 | 12/1992 |

*Primary Examiner*—Glenn Caldarola
*Assistant Examiner*—Alexis Wachtel
(74) *Attorney, Agent, or Firm*—Dilworth & Barrese, LLP

(57) ABSTRACT

A cracking furnace for the pyrolysis heating of an organic feedstock includes a heating section and at least one convection section. In one embodiment the furnace includes first and second convection sections positioned along opposite sides of the heating section. The openings for admitting flue gas to the convection sections can be at the top or the bottom of the heating section. In another embodiment the furnace includes a plurality of passageways for the communication of flue gas from the heating section to the convection section. The passageways can be positioned at the top or the bottom of the heating section. The passageways provide a more even flow of flue gas through the heating section by preventing recirculation of the flue gas within the heating chamber.

19 Claims, 10 Drawing Sheets

CRACKING FURNACE WITH MORE UNIFORM HEATING

BACKGROUND

1. Technical Field

The present invention relates to a cracking furnace and more particularly to a tubular furnace for thermal cracking of an organic feedstock such as petroleum hydrocarbons.

2. Background of the Art

Cracking furnaces for the pyrolysis heating of petroleum hydrocarbons to produce olefins are known in the art. Typical petroleum feedstocks include, e.g., ethane, propane, and naphtha. Typical products include ethylene, propylene, butadiene, and other hydrocarbons.

FIG. 1A illustrates a typical cracking furnace arrangement. Cracking furnace 10 includes a heating section 11 and a convection section 12 which is offset from the heating section 11 for the reasons stated below. Burners 13 are positioned on the floor of the radiant chamber 18 of the heating section.

One or more tubular coils 14 are positioned in the heating section 11. The feedstock flows through tubes 14*a* of the coils and undergoes pyrolysis at the cracking temperature (usually 950° C. to 1200° C.) wherein saturated hydrocarbons are cracked to produce olefins and hydrogen. The flow rate of the feedstock through the tubes is adjusted to provide a desired residence time at the reaction temperature. After the cracking has proceeded to the desired degree, it is important to quench the gas flow emerging from the radiant chamber to halt the reaction since continued reaction might produce unwanted by-products. Gas flow exiting the radiant chamber 18 is passed through heat exchangers 15 to quench the reaction. These heat exchangers are usually positioned on top of the radiant chamber 18, thereby requiring the convection section 12 to be offset. The heating section 11 typically has a length L of about 20 meters, a width W of about 3.5 meters and a height H of about 13.5 meters. The tubular coils 14 are generally arranged in a plane which is parallel to the plane defined by the vertical and lengthwise axes of the convection section 12. The convection section 12 is generally a stack for exhausting the furnace flue gas to the atmosphere. Convection section 12 usually contains one or more sections 16 for heat recovery wherein the feed is preheated by the flue gas, as well as sections for stack gas treatment to reduce emissions of pollutants such as nitrogen oxides and sulfur oxides.

Recent trends in ethylene production plants have led to larger and more intensely fired cracking furnaces. The capacity of a typical heater have increased from 100,000 metric tons per year to 180,000 metric tons per year. It is desired to increase capacity to at least 250,000 metric tons per year. To accomplish the increased furnace capacity the coil length can be increased, thereby increasing the height of the radiant chamber. Or, the number of coils can be increased, thereby increasing the length of the radiant chamber. However, neither of these changes are desirable. If the height of the radiant chamber is increased, it becomes more difficult to heat the coils evenly. The convection section tube length limits the length of the radiant chamber. If the radiant chamber becomes much longer, then the convection section problems arise with the flue gas flow from the radiant section into the convection section.

EP 0,519,230 discloses a pyrolysis heater in which the vertical tubes of the tubular coils provided in a plurality of parallel rows with each row being in a plane perpendicular to a plane through the longitudinal axis of the convection section. That is, the coils are oriented at 90° from the conventional arrangement of coils as depicted in FIG. 1A. While this arrangement can provide significant advantages with respect to increasing furnace capacity improvements can yet be made in furnace construction to facilitate such an arrangement.

In a relatively wide furnace such as that described in EP 0,519,230, wherein the tube coils are perpendicular to the longitudinal axis of the furnace, the flue gas can undergo recirculation within the radiant chamber. Referring now to FIG. 1B, a furnace 50 is shown with heating section 51, convection section 52 and burners 54. Flue gas flows are illustrated by arrows A, B, and C. While flue gas flows A and B tend to flow directly to the inlet opening 53 leading to the convection section 52, eddies C of flue gas can form, especially at the side of the chamber furthest away from the inlet 53 to the convection section where dead space tends to develop. These eddies result in inconsistencies in heating. Uniform heating throughout the radiant chamber is important for producing a consistent product and for facilitating process control.

SUMMARY

A furnace is provided herein for the pyrolysis heating of an organic feedstock. In one embodiment the furnace comprises: (a) a heating section including a heating chamber, a plurality of tubular coils positioned in the heating chamber, and a plurality of burners, wherein the heating section has an upper portion, a lower portion, a lengthwise axis, and first and second opposite lateral sides; and (b) first and second convection sections connected to the heating section, the first convection section extending lengthwise along the first lateral side of the heating section and the second convection section extending lengthwise along the second lateral side of the heating section, each of the first and second convection sections having an opening communicating with heating section to permit the passage of flue gas therethrough. The furnace can also comprise a plurality of passageways for the communication of flue gas from the heating chamber to a convection section of the furnace, each said passageway having an entrance opening for admitting flue gas into the passageway, and an exit opening for passing the flue gas into the convection section.

The invention herein provides for a more even flow of flue gas through the heating section of the furnace by reducing flue gas recirculation.

BRIEF DESCRIPTION OF THE DRAWINGS

Various embodiments are described herein with reference to the drawings wherein.

DETAILED DESCRIPTION OF PREFERRED EMBODIMENT(S)

The invention described herein provides even flue gas flow and more uniform heat transfer to the tubular coils in a cracking furnace by incorporating into the furnace two convection sections rather than one and/or a plurality of configured passageways for the communication of flue gas from the radiant heating section of the furnace to the convection section. The invention can be used in conventional furnaces, but is particularly advantageous for furnaces having a coil arrangement in planes transverse to the longitudinal axis of the furnace. Such furnaces are wider and more prone to the development of dead zones of recirculating flue gas in the radiant heating section of the furnace.

Figure 2:
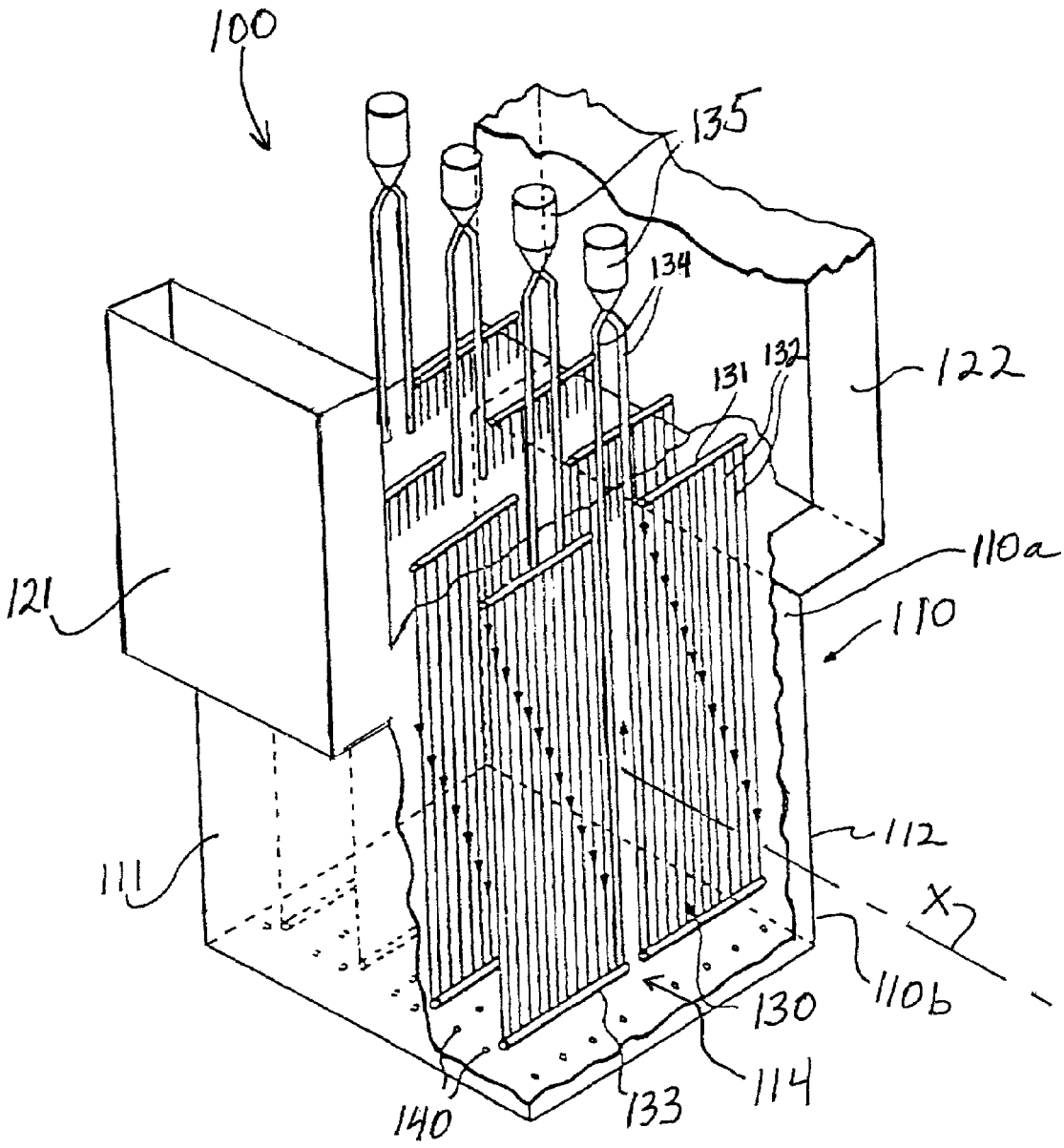
FIG. 2 is a cut-away perspective view illustrating an embodiment of the cracking furnace of the present invention possessing first and second convection sections.
Figure 3:
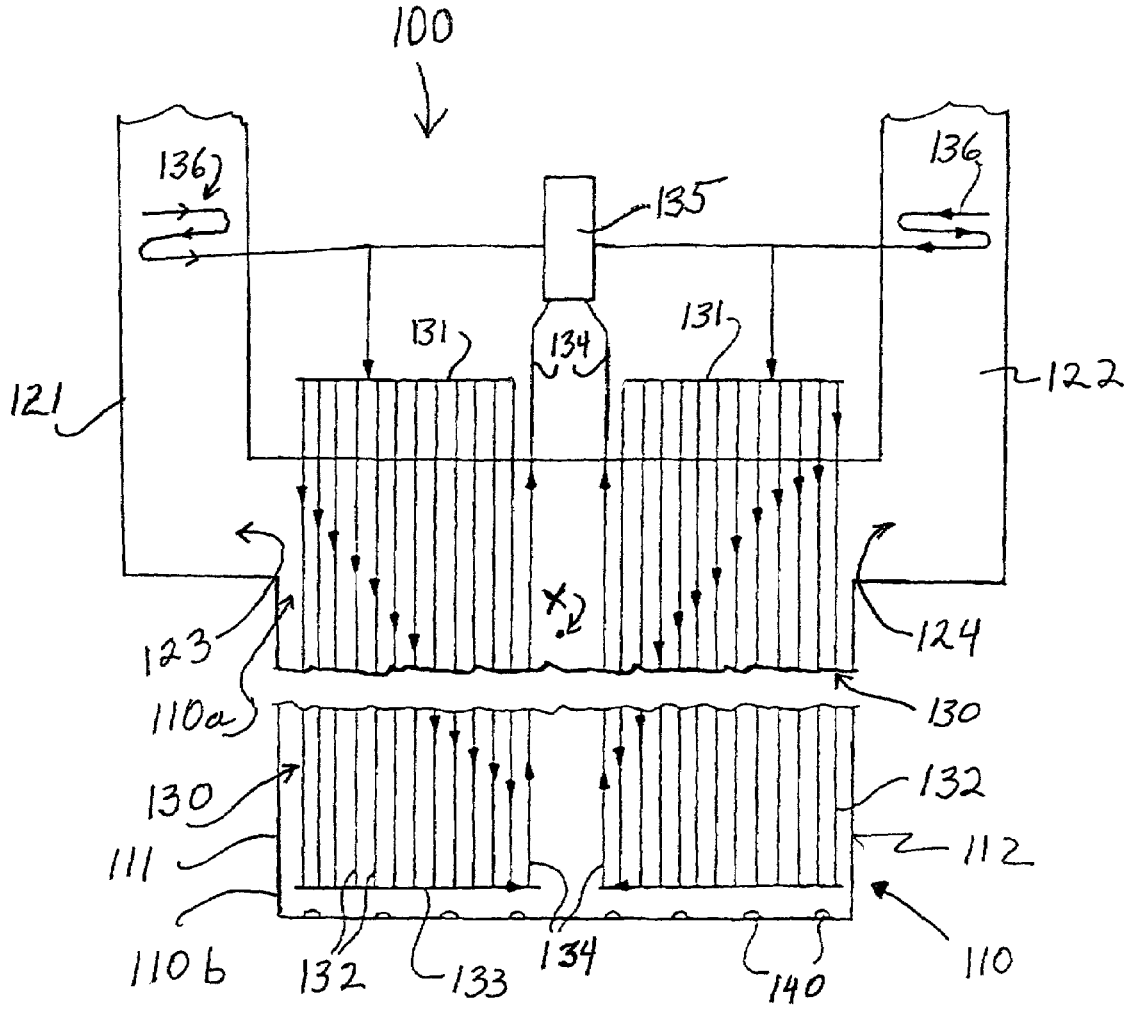
FIG. 3 is a front elevational view of the embodiment of the furnace shown in FIG. 2.
Figure 8:
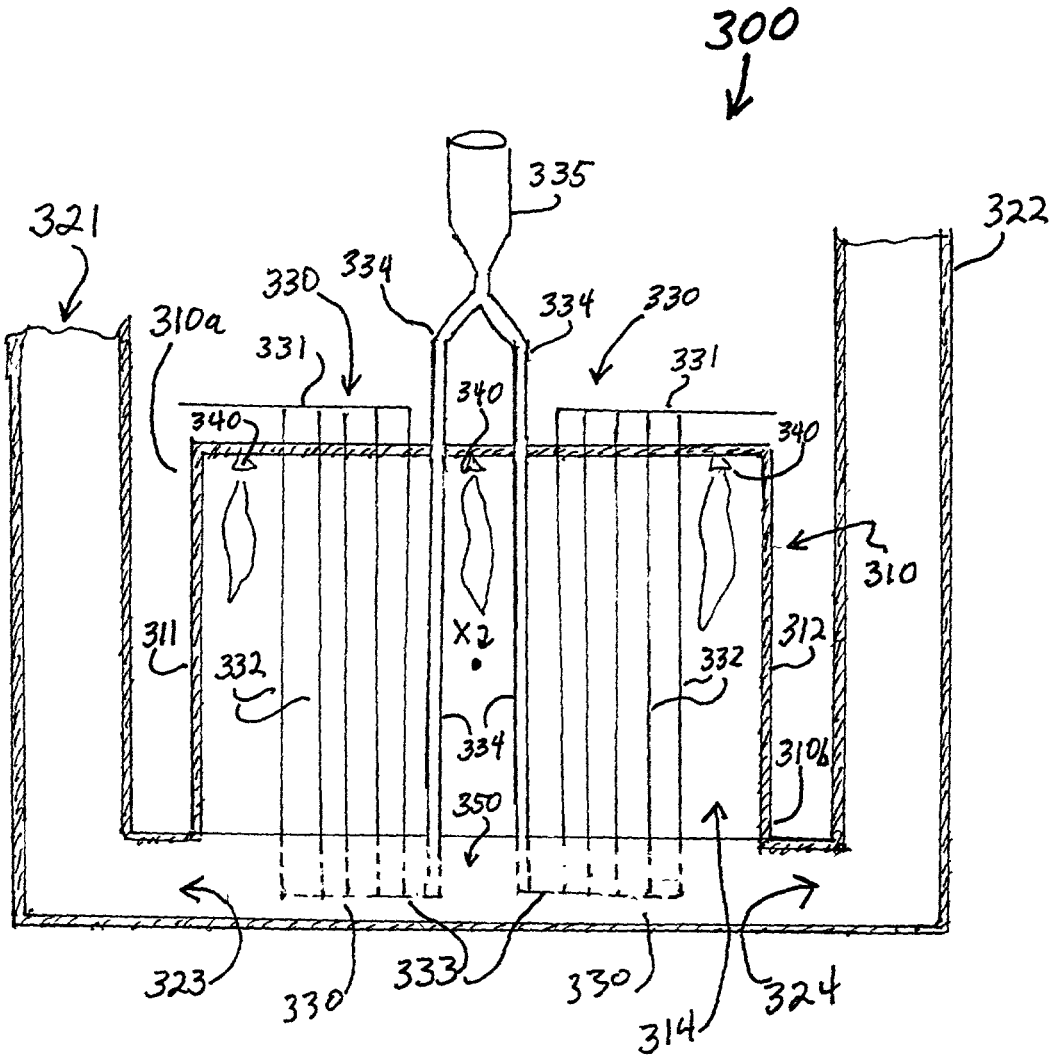
FIG. 8 is a front elevational view of another embodiment of the present invention having passageways at the bottom portion of the heating section.

Referring now to FIGS. 2 and 3, a cracking furnace 100 for the pyrolysis of an organic feedstock is illustrated. Typical feedstocks include, for example, ethane, propane, naphtha or other hydrocarbons. The pyrolytic heating of the feedstock produces unsaturated compounds (i.e., olefins such as ethylene, propylene, etc.) and hydrogen. Furnace 100 includes a heating section 110 and first and second convection sections 121 and 122, respectively. The first convection section 121 extends along the first lateral side 111 of the heating section 110, and the second convection section 122 extends along the second lateral side 112 of the heating section 110. Heating section 110 includes an interior radiant heating chamber 114 in which a plurality of tubular coils 130 are arranged in parallel rows. Heating section 110 further includes a longitudinal axis X which defines a lengthwise extension of the furnace, and upper and lower portions 110*a* and 110*b*, respectively. Burners 140 are preferably arranged in rows and positioned between the rows of tubular coils 130 and also between the tubular coils and the furnace side walls. In the embodiment illustrated in FIGS. 2 and 3, the burners are positioned in the lower portion 110*b* of the heating section, and the first and second convection sections 121 and 122 are connected to the opposite lateral sides 111 and 112, respectively, at the upper portion of the heating section. That is, the openings 123 and 124, which permit communication of flue gas from the heating chamber 114 to the first and second convection sections 121 and 122, are at the upper portion 110*a* of the heating section 110. The flue gas resulting from the combustion of fuel by the burners flows upward within the heating section 110 and then out through the convection sections 121 and 122. However, in an alternative arrangement, as schematically illustrated in FIG. 8 and described below, the burners can be positioned in the upper portion of the heating chamber and the convection sections can be connected to the lower portion of the heating section.

The tubular coils are arranged in multiple parallel rows with one or more coils in each row. Each row lies in a plane perpendicular to the lengthwise axis X.

As shown in FIGS. 2 and 3 by way of example, the tubes 132 in each row are arranged to provide two passes for each feed stream of hydrocarbon to be pyrolyzed. More particularly, a plurality of tubes 132, in one row are connected to a horizontal manifold 133 which is connected to a vertical tube 134 having an inside diameter greater than that of the tubes 132. The upper ends of tubes 132 are connected to an inlet manifold 131 for providing a hydrocarbon feed (or other organic feed) to the tubes 132, and the tops of tubes 134 are connected to a transfer line exchanger 135 for receiving and cooling pyrolysis effluent to a quench temperature low enough to inhibit further pyrolysis reaction from taking place. Thus, as shown, feed to be pyrolyzed is introduced into the tops of tubes 132, passes downwardly through tubes 132 into manifold 133 and then upwardly through tubes 134 for introduction into a transfer line exchanger 135. A feed to be pyrolyzed may be preheated in convection tubes 136 located in convection sections 121 and 122, with the preheated feed being introduced into tubes 132 through manifolds 131.

Thus, for example, a single row of vertical tubes may be divided into two sets of tubes, with each set forming one coil. Each coil is comprised of several tubes 132 providing a first pass, with each of the tubes 132 being connected to a single tube 134 through manifold 133 which provides the second pass.

Although a two pass coil is described for purposes of exemplification, the coil arrangement can include any number of passes from single pass to multi pass arrangements of 2, 3, 4, or more passes, as desired.

Employing two convection sections reduces the possibility of flue gas recirculation and provides a more even flow of flue gas throughout the heating section by reducing dead space. By having two convection sections instead of one the maximum distance from any burner to the convection section is reduced by half. In addition, the volume of flue gas going into each convection section is reduced by half. The combination of these two effects greatly reduces the tendency to create preferential flue gas flow paths inside the radiant chamber.

An additional benefit is that the convection section itself can be reduced significantly in height and width. Using the coil arrangement described herein, the furnace capacity is increased but the convection tube length is reduced. In order to maintain sufficient cooling capacity the convection section would have to be increased in both height and width if a single convection section were used. Both of these increases are very expensive. Increasing the width means longer and thicker tube supports. Increasing the height means more platforms and structural steel to withstand the additional loading. However, if two convection sections are employed rather than one, each will have a smaller height and width as compared with a single convection section with the same cooling capacity as the two smaller convection sections combined.

Figure 1A:
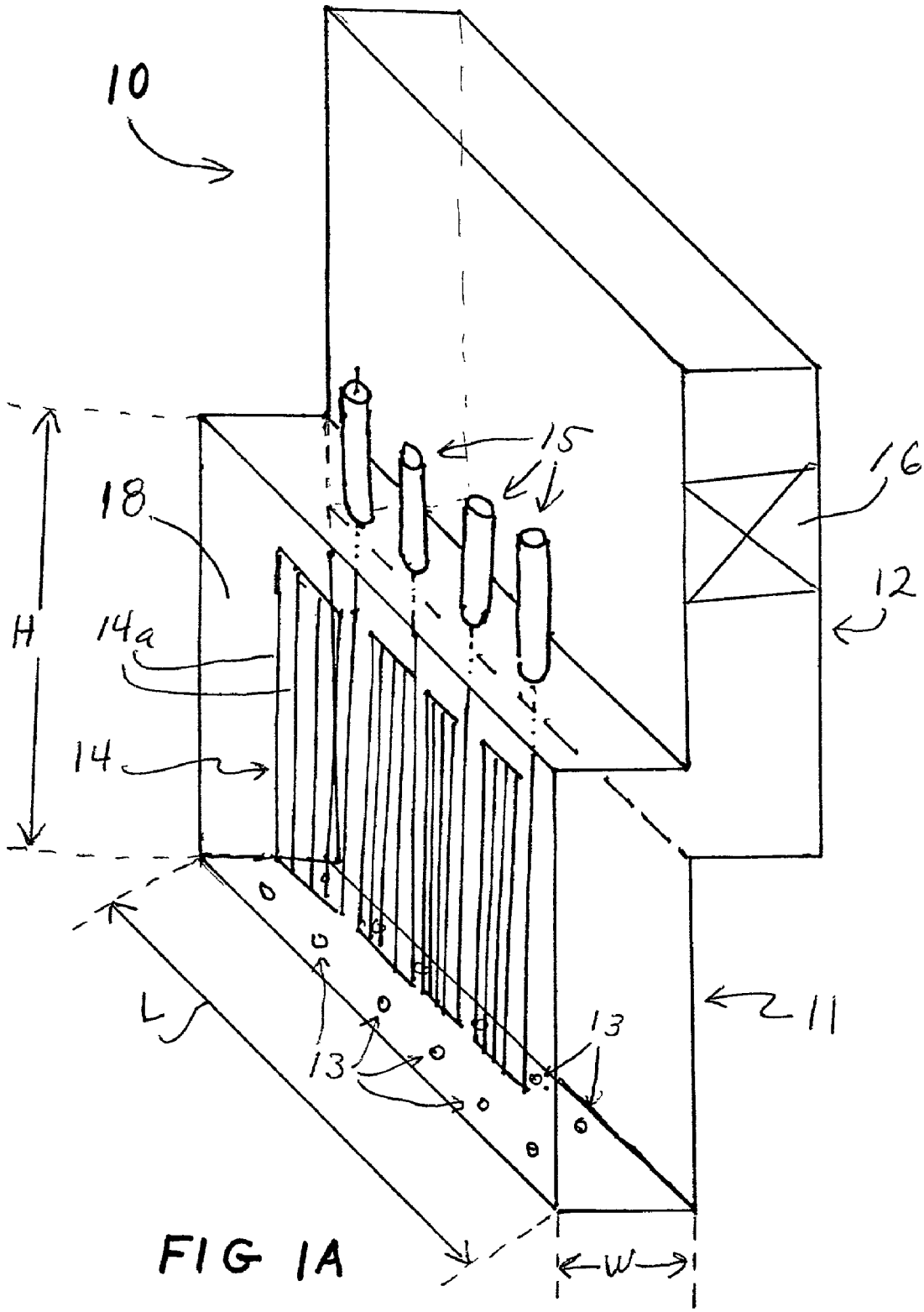
FIG 1A PRIOR ART
FIGS. 1A and 1B are schematic illustrations of prior art type furnaces.
Figure 1B:
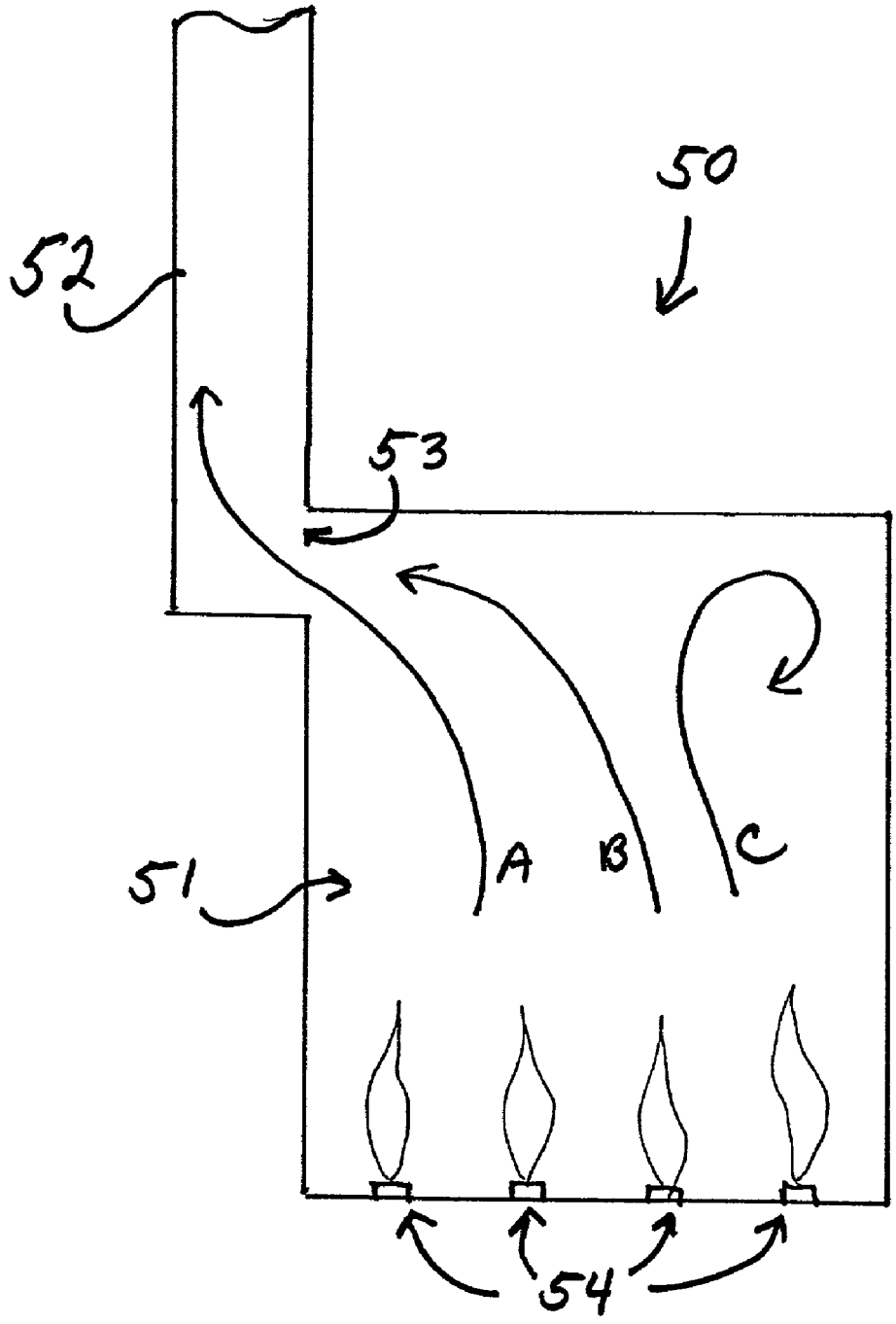
FIG 1B PRIOR ART
Figure 4:
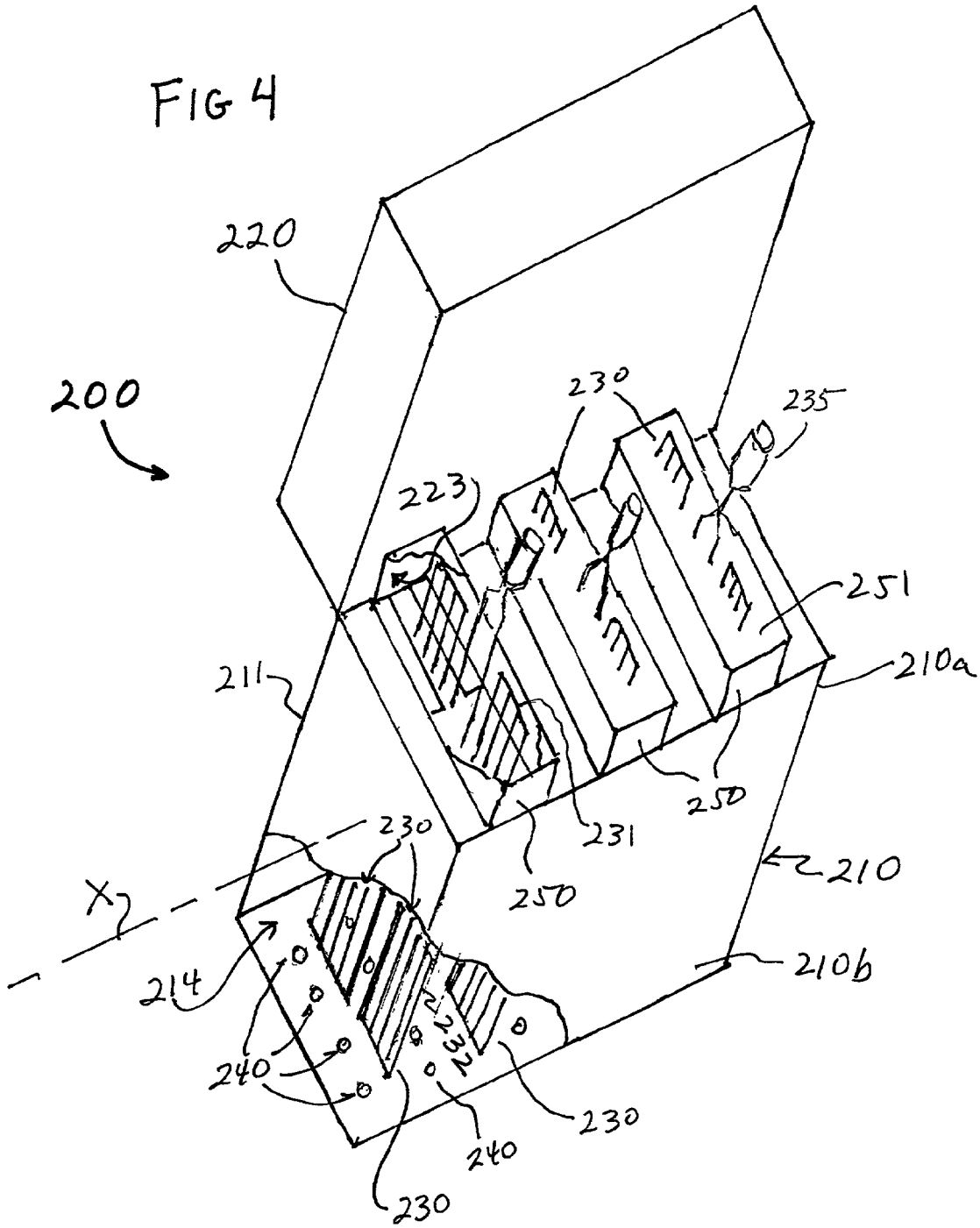
FIG. 4 is a perspective view showing another embodiment of the furnace of the present invention possessing passageways at the upper portion of the heating section for the communication of flue gas from the heating section to the convection section of the furnace.
Figure 5:
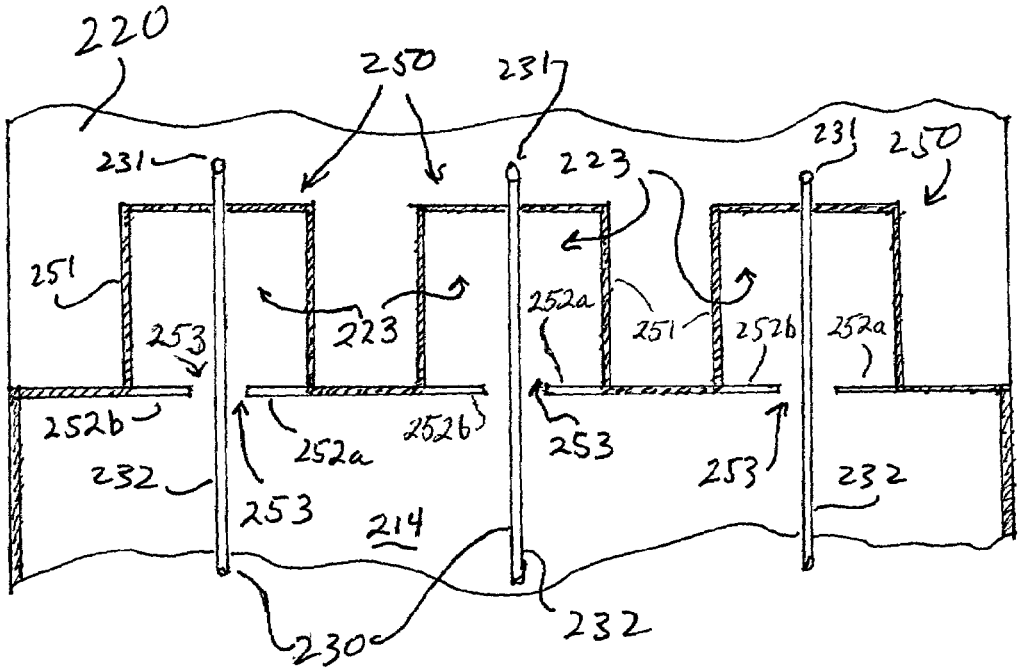
FIG. 5 is a side view of the passageways.
Figure 6:
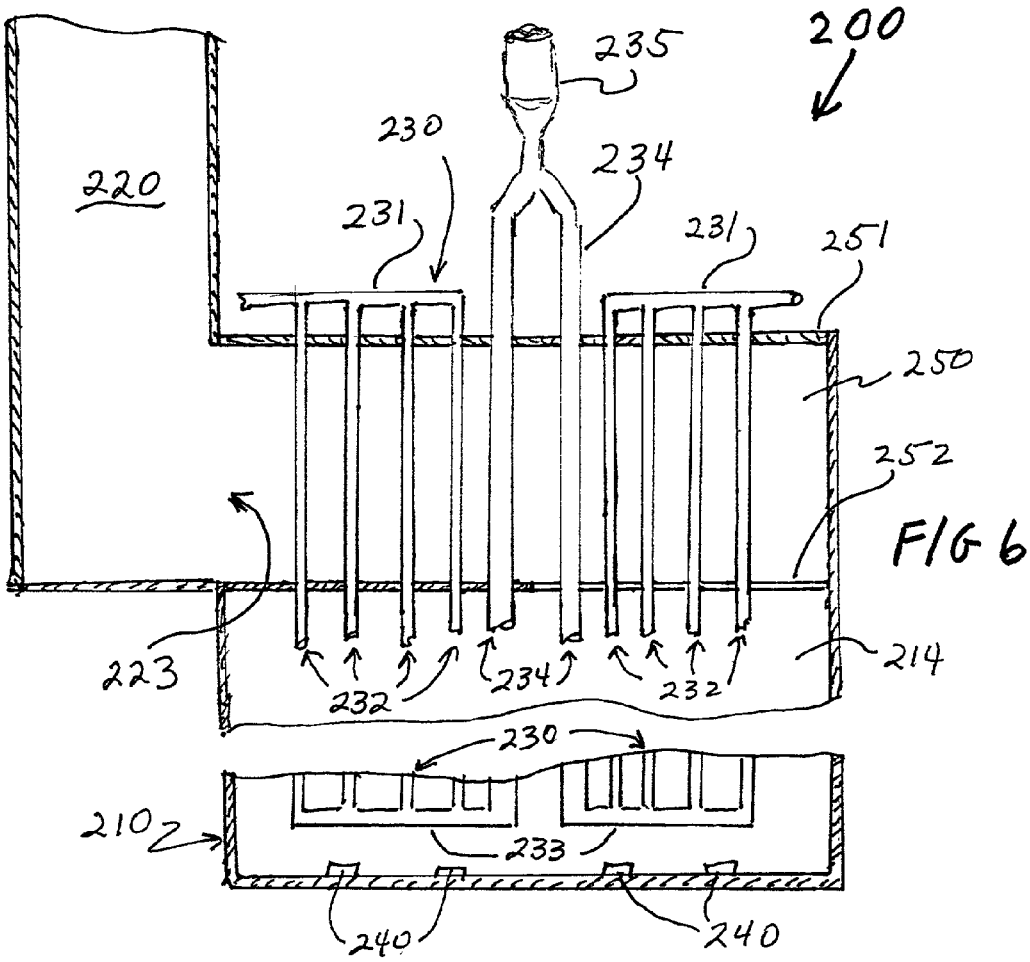
FIG. 6 is a partial front elevational view of the embodiment of the furnace shown in FIG. 4.

Referring now to FIGS. 4, 5 and 6, a cracking furnace 200 includes a heating section 210 and at least one convection section 220 extending along a lateral side 211 of the heating section 210. Heating section 210 includes an interior radiant heating chamber 214 in which a plurality of tubular coils 230 are arranged in parallel rows. Heating section 210 further includes a longitudinal axis X which defines a lengthwise extension of the furnace, and upper and lower portions 210*a* and 210*b*, respectively. Burners 240 are preferably arranged in rows and positioned between the rows of tubular coils 130 and also between the tubular coils and the furnace side walls. In the embodiment 200 illustrated in FIGS. 4–7 , the burners are positioned in the lower portion 210*b* of the heating section. The convection section 220 is connected to the lateral side 211 at the upper portion 210*a* of the heating section. That is, openings 223, which permit communication of flue gas from the heating chamber 214 to the convection section 220, are at the upper portion 210*a* of the heating section 210. The flue gas resulting from the combustion of fuel by the burners flows upward within the heating section 210 and then out through the convection sections 220. However, in an alternative arrangement, as schematically illustrated in FIGS. 8–1 0, the burners can be positioned in the upper portion of the heating chamber and the convection sections can be connected to the lower portion of the heating section as described below.

The tubular coils are arranged in multiple parallel rows with one or more coils in each row. Each row lies in a plane perpendicular to the lengthwise axis X.

As shown in FIG. 6 for purposes of exemplification, the tubes 232 in each row are arranged to provide two passes for each feed stream of hydrocarbon to be pyrolyzed. More particularly, a plurality of tubes 232 in one row are connected to a horizontal manifold 233 which is connected to a vertical tube 234 having an inside diameter greater than the tubes 232. The upper ends of tubes 232 are connected to an inlet manifold 231 for providing a hydrocarbon feed to the tubes 232, and the tops of tubes 234 are connected to a transfer line exchanger 235 for receiving and cooling pyrolysis effluent to a quench temperature low enough to inhibit further pyrolysis reaction from taking place. Thus, as shown, hydrocarbon to be pyrolyzed is introduced into the tops of tubes 232, passes downwardly through tubes 232 into manifold 233 and then upwardly through tubes 234 for introduction into a transfer line exchanger 235. In a manner similar to the previously described embodiment 100 illustrated in FIG. 3, feed to be pyrolyzed may be preheated in convection tubes located in the convection section 220 with the preheated feed being introduced into the tubes 232 through the inlet manifolds 231.

Thus, for example, a single row of vertical tubes may be divided into two sets of tubes, with each set forming one coil. Each coil is comprised of several tubes 232 providing a first pass, with each of the tubes 232 being connected to a single tube 234 through manifold 233 which provides the second pass.

As mentioned above, any coil arrangement, including single pass or multi pass arrangements, is contemplated as being within the scope of the invention.

In a preferred embodiment, the furnace includes a plurality of configured passageways 250 for the communication of flue gas from the radiant heating chamber 214 to the convection section 220. The passageways 250 facilitate the even flow of flue gas while suppressing recirculation within the radiant heating chamber 214. The passageways 250 are parallel to each other and are oriented laterally so as to direct the flue gas laterally into the convection section 220. In embodiment 200, the passageways 250 are positioned at the upper portion 210*a* of the heating section 210. The tubular coils 230 are disposed through respective passageways 250. Each passageway has a housing 251 which at least partially defines and encloses the passageway. Each passageway 250 communicates at one end with the convection section 220 by means of exit opening 223. The bottom of the passageway 250 has a configured inlet opening 253 which includes a relatively wide portion 253*a* and a relatively narrow portion 253*b*. Narrow portion 253*b* is defined by the gap between plates 252*a* and 252*b* which form floor portion 252 of the passageway.

Figure 7:
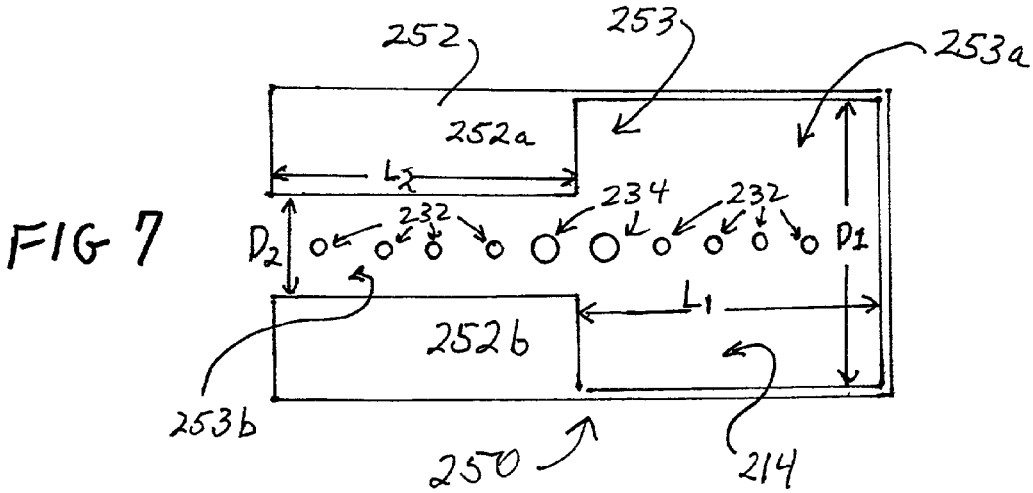
FIG. 7 is a plan view of a passageway.

Referring to FIG. 7, relatively wide portion 253*a* of the inlet opening is defined by dimensions $L_1$ and $D_1$. Relatively narrow portion of the inlet opening 253*b* is defined by dimensions $L_2$ and $D_2$. The relative sizes of portions 253*a* and 253*b* can be selected to produce any desired type of flue gas flow within the radiant heating chamber 214. While any suitable dimensions can be selected, by way of example, the ratio $L_1/L_2$ can range from 0.8 to 1.2, preferably 0.9 to 1.1, and the ratio-of $D_1/D_2$ can range from 1.1 to 10, preferably 1.5 to 4, and more preferably 2 to 3, although dimensions outside of these ratios can also be selected. As can be seen, $D_1$ is larger than $D_2$, which tends to direct more gas flow through $D_1$. Since the relatively wider portion 253*a* of the inlet opening 253 is located further away from exit opening 223 than is the narrower portion 253*b*, the flow of flue gas is biased towards the corner of the heating chamber further away from the convection section. The dimensions of tunnel and inlet opening are chosen such that the aggregate pressure loss of the flue gas from the burner furthest away from the convection section is equal to the aggregate pressure loss of the flue gas from the burner closest to the convection section. For a single convection system the tunnel openings are wider at the end opposite the convection section. For a dual convection system the tunnel openings are wider in the middle of the furnace. This inhibits the flue gas from taking the shortest path to the convection section and eliminates dead zones of recirculating flue gas in the radiant section that would otherwise occur. Accordingly, the overall flow of flue gas through the heating section 210 is made more even with the concomitant reduction of localized hot spots or cool spots.

While embodiment 200 is illustrated with one convection section 220, it should readily be appreciated that, alternatively, the furnace 200 can also include a second convection section extending along the side of the heating section 210 opposite that of convection section 220.

Figure 9:
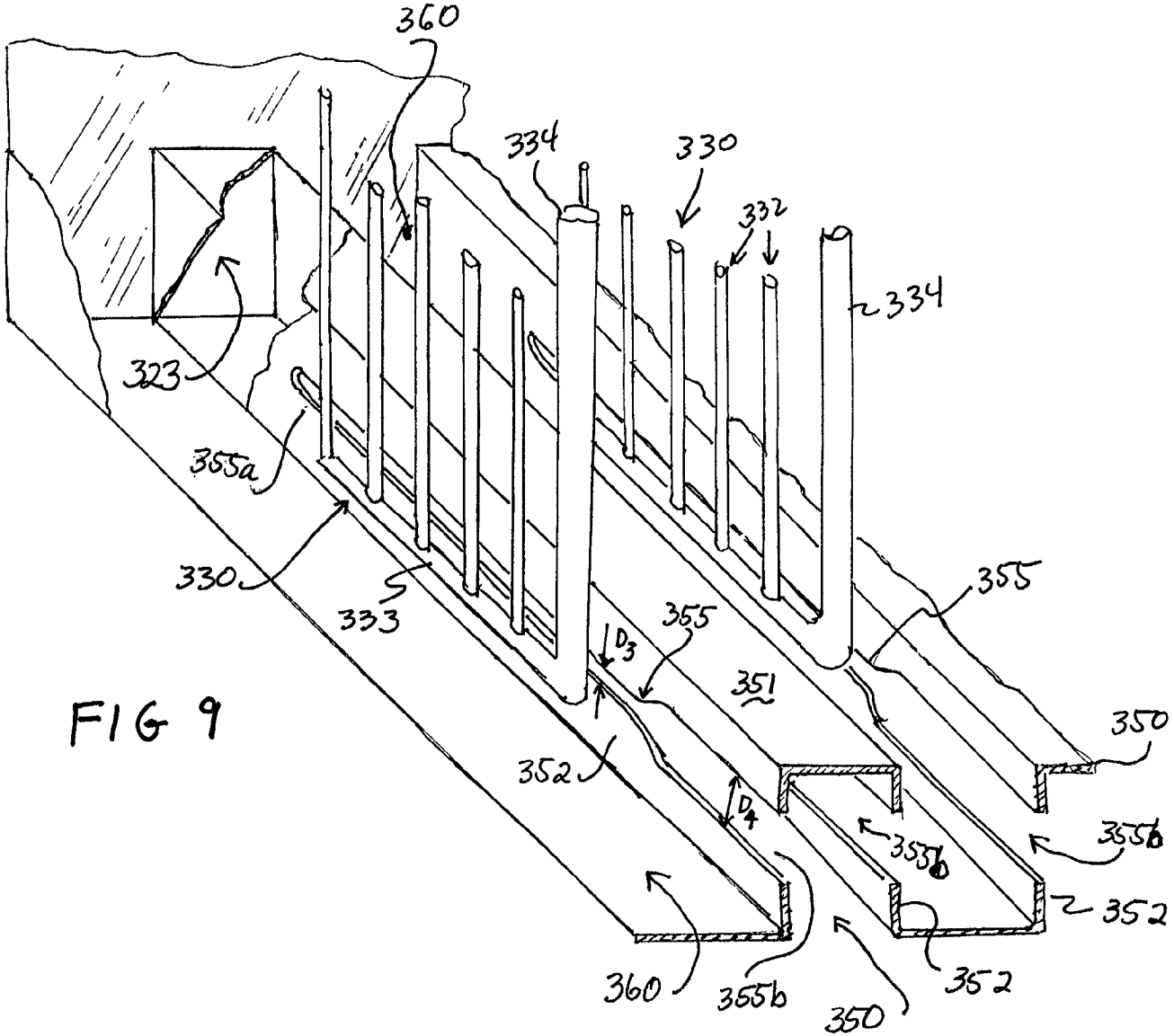
FIG. 9 is a perspective view of passageway of the furnace shown in FIG. 8; and, FIG. 10 is a side view of the furnace shown in FIG. 8.
Figure 10:
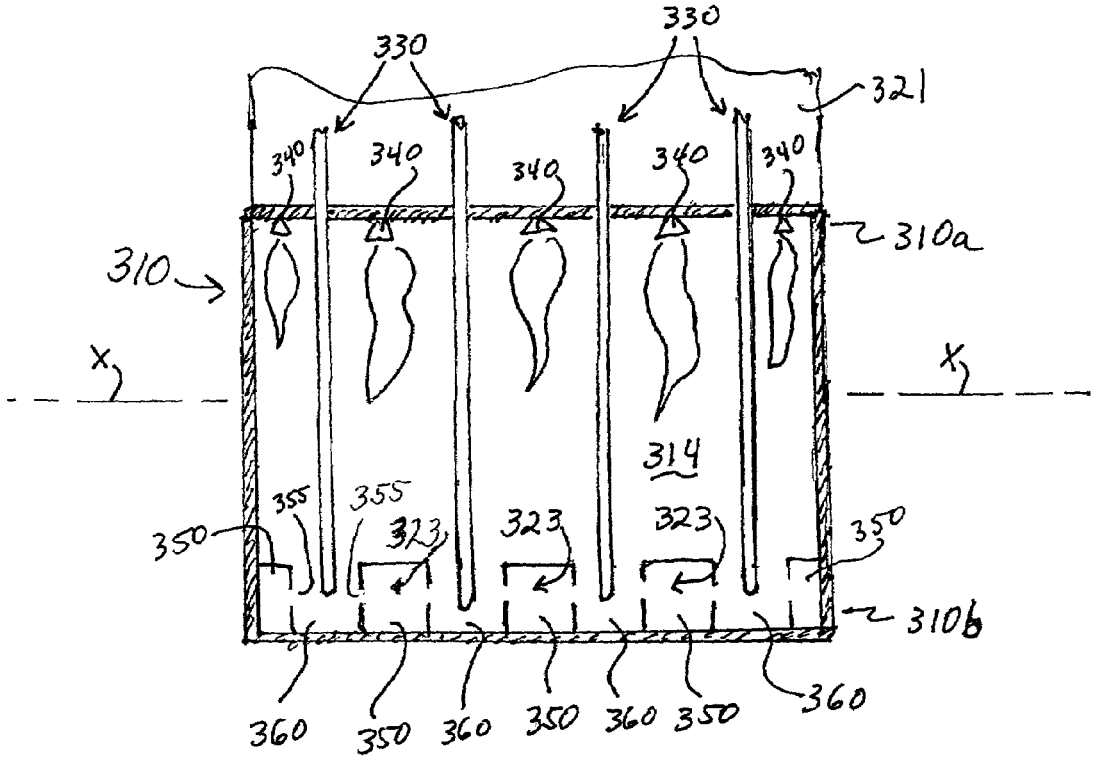

Referring now to FIGS. 8, 9 and 10 by way of example, a cracking furnace 300 for the pyrolysis of an organic feedstock is illustrated. Furnace 300 includes a heating section 310 and first and second convection sections 321 and 322, respectively. The first convection section 321 extends along the first lateral side 321 of the heating section 310, and the second convection section 311 extends along the second lateral side 312 of the heating section 310. Heating section 310 includes an interior radiant heating chamber 314 in which a plurality of tubular coils 330 are arranged in parallel rows. Heating section 310 further includes a longitudinal axis X which defines a lengthwise extension of the furnace, and upper and lower portions 310*a* and 310*b*, respectively. Burners 340 are preferably arranged in rows and positioned between the rows of tubular coils 330. In furnace 300 the burners are positioned in the upper portion 310*a* of the heating section and the first and second convection sections 321 and 322 are connected to the opposite lateral sides 311 and 312, respectively, at the lower portion 310*b* of the heating section. That is, the openings 323 and 324, which permit communication of flue gas from the passageways 350 to the first and second convection sections 321 and 322, are at the lower portion 310*b* of the heating section 310. The flue gas resulting from the combustion of fuel by the burners flows downward within the heating section 310 and then through passageways 350 at the bottom of the heating section 310 and then out through openings 323 and 324 into the convection sections 321 and 322, respectively.

The tubular coils 330 are arranged in multiple parallel rows with one or more coils in each row. Each row lies in a plane perpendicular to the lengthwise axis X.

As shown in FIG. 8, the tubes 332 in each row are arranged to provide two passes for each feed stream of hydrocarbon to be pyrolyzed. More particularly, a plurality of tubes 332, in one row are connected to a horizontal manifold 333 which is connected to a vertical tube 334 having an inside diameter greater than the tubes 332. The upper ends of tubes 332 are connected to an inlet manifold 331 for providing a hydrocarbon feed (or other organic feed) to the tubes 332, and the tops of tubes 334 are connected to a transfer line exchanger 335 for receiving and cooling pyrolysis effluent to a quench temperature low enough to inhibit further pyrolysis reaction from taking place. Thus, as shown, hydrocarbon to be pyrolyzed is introduced into the tops of tubes 332, passes downwardly through tubes 332 into manifold 333 and then upwardly through tubes 334 for introduction into a transfer line exchanger 335. In a manner similar to the previously described embodiment 100 illustrated in FIG. 3, feed to be pyrolyzed may be preheated in convection tubes located in convection sections 321 and 322, with the preheated feed being introduced into tubes 332 through manifolds 331.

Thus, for example, a single row of vertical tubes may be divided into two sets of tubes, with each set forming one coil. Each coil is comprised of several tubes 332 providing a first pass, with each of the tubes 332 being connected to a single tube 334 through manifold 133 which provides the second pass.

As mentioned above, any coil arrangement, including single pass or multi pass arrangements, is contemplated as being within the scope of the invention.

In a preferred embodiment, the furnace 300 includes a plurality of configured passageways 350 for the communication of flue gas from the radiant heating chamber 314 to the convection sections 321 and 322. The passageways 350 facilitate the even flow of flue gas within the radiant chamber to provide even and consistent pyrolysis within the tubular coils 330. The passageways 350 are parallel to each other and are oriented laterally so as to direct the flow of flue gas laterally into the convection sections 321 and 322. In embodiment 300 the passageways are positioned in the lower portion 310*b* of the heating section 310. The passageways 350 are separated and spaced apart by troughs 360. The bottom portion of the coils 330 are disposed through the troughs and can be secured in position by brackets, struts, or any other suitable means of support known to those skilled in the art. Each passageway 350 has a housing 351 which at least partially defines and encloses the passageway. The passageways communicate at each end with a respective one of convection sections 321 and 322 by means of openings 323 and 324, respectively. It should be noted that although two convection sections are included in the embodiment shown in FIGS. 8 to 10, the furnace 300 can optionally be constructed with only one convection section.

The housing 351 of the passageway 350 includes side walls 352. Each sidewall includes one or more openings 355 to allow passage of flue gas from the radiant chamber 314 into the passageway. The opening 355 can be of any shape or dimension. As can be seen in FIG. 9, a preferred opening 355 comprises an elongated slot. The slot can be of any suitable size, and can alternatively be of the same size along its entire length or can be wider at some location than at others. As shown in FIG. 9, slot 355 includes a relatively narrow portion 355*a* having a width $D_3$ and a relatively wider portion 355*b* having a width $D_4$. The relative dimensions of 355*a* and 355*b* can be selected to produce any desired type of flue gas flow within the heating chamber 314. While any suitable dimensions can be selected, by way of example, the ratio of $D_4/D_3$ can range from 1.1 to 10, preferably 1.5 to 4, and more preferably from 2 to 3, although dimensions outside these ratios can also be selected.

$D_4$ is larger than $D_3$, which tends to direct more gas flow through $D_4$. Preferably, the narrower portion 355*a* is closer to the opening 323 or 324 leading to the convection section. In a two convection section embodiment such as furnace 300, a single slot 355 can extend along each side wall of the passageway, each slot having a wide middle section 355*b* between two narrow sections 355*a*, the narrow sections 355*a* being in a closer proximity to the openings 323 and 324, and the wide section 355*b* being in closer proximity to the middle of the heating chamber 314. The dimensions of tunnel and inlet opening are chosen such that the aggregate pressure loss of the flue gas from the burner furthest away from the convection section is equal to the aggregate pressure loss of the flue gas from the burner closest to the convection section. For a single convection system the tunnel openings are wider at the end opposite the convection section. For a dual convection system the tunnel openings are wider in the middle of the furnace. This inhibits the flue gas from taking the shortest path to the convection section and eliminates dead zones in the radiant section that would otherwise occur. Also, the flue gas is drawn past the bottom portions of the coils, which are positioned in the troughs 360 separating the passageways 350, which increases the efficiency of the heating.

While the above description contains many specifics, these specifics should not be construed as limitations on the scope of the invention, but merely as exemplifications of preferred embodiments thereof. Those skilled in the art will envision many other possibilities within the scope and spirit of the invention as defined by the claims appended hereto.

What is claimed is:

1. A furnace for the pyrolysis heating of an organic feedstock, which comprises:

a) a heating section including a heating chamber, a plurality of tubular coils positioned in the heating chamber, and a plurality of burners, wherein the heating section has an upper portion, a lower portion, a lengthwise axis, and first and second opposite lateral sides; and b) first and second convection sections connected to the heating section, the first convection section extending lengthwise along the first lateral side of the heating section and the second convection section extending lengthwise along the second lateral side of the heating section, each of the first and second convection sections having an opening communicating with heating section to permit the passage of flue gas therethrough.

2. The furnace of claim 1 wherein the openings in the first and second convection sections communicate with the upper portion of the heating section.

3. The furnace of claim 1 wherein the openings in the first and second convection sections communicate with the lower portion of the heating section.

4. The furnace of claim 1 wherein the tubular coils are arranged in parallel rows, each row lying in a plane perpendicular to the lengthwise axis of the heating section.

5. A furnace for the pyrolysis heating of an organic feedstock, which comprises:

a) a heating section including an upper portion, a bottom portion, a lengthwise axis, first and second opposite lateral sides, a heating chamber, a plurality of tubular coils positioned within the heating chamber, a plurality of burners, and a plurality of laterally extending spaced apart passageways for the communication of flue gas from the heating chamber to a convection section of the furnace, each said passageway having an entrance opening for admitting flue gas into the passageway, and an exit opening for passing the flue gas into the convection section; and b) at least a first convection section connected to a lateral side of the heating section.

6. The furnace of claim 5 wherein the first convection section extends lengthwise along one of said first and second opposite lateral sides of the heating section.

7. The furnace of claim 6 wherein the plurality of tubular coils are arranged in parallel rows, each row lying in a plane perpendicular to the lengthwise axis of the heating section.

8. The furnace of claim 5 wherein the passageways are oriented parallel to each other.

9. The furnace of claim 5 wherein the entrance opening to the passageway has a relatively wider portion and a relatively narrow portion.

10. The furnace of claim 9 wherein the relatively narrow portion of the entrance opening of the passage way is between the relatively wider portion of the entrance opening of the passageway and the exit opening of the passageway.

11. The furnace of claim 5 wherein the passageways are positioned in the top portion of the heating section.

12. The furnace of claim 5 wherein the passageways are positioned in the bottom portion of the heating section.

13. The furnace of claim 6 further comprising a second convection section extending lengthwise along the other one of said first and second lateral sides of the heating section opposite the first convection section.

14. The furnace of claim 5 wherein at least some burners are positioned in the upper portion of the heating section.

15. The furnace of claim 14 wherein the passageways are positioned in the bottom portion of the heating section.

16. The furnace of claim 15 further comprising a second convection section extending lengthwise along the other one of the first and second lateral sides of the heating section opposite the first convection section.

17. The furnace of claim 5 wherein at least some burners are positioned in the bottom portion of the heating section.

18. The furnace of claim 17 wherein the passageways are positioned in the bottom portion of the heating section.

19. The furnace of claim 18 further comprising a second convection section extending lengthwise along the other one of the first and second lateral sides of the heating section opposite the first convection section.

* * * * *